United States Patent [19]

White

[11] 4,089,703

[45] May 16, 1978

[54] HOT DETERGENT PROCESS

[75] Inventor: Nelson Stanley White, Shreveport, La.

[73] Assignee: White Chemical Company, Inc., Shreveport, La.

[21] Appl. No.: 753,905

[22] Filed: Dec. 23, 1976

[51] Int. Cl.[2] ..... B08B 3/08; B08B 9/02

[52] U.S. Cl. ..... 134/22 C; 134/28; 134/29; 134/40; 166/304; 166/311; 252/8.55 B

[58] Field of Search ..... 134/22 C, 27, 28, 29, 134/40, 3; 252/8.55 B, 135, 156; 166/304, 311, 312

[56] References Cited

U.S. PATENT DOCUMENTS

| | | | |
|---|---|---|---|
| 139,010 | 5/1873 | Looney | 166/304 X |
| 3,076,757 | 2/1963 | Knox et al. | 166/304 X |
| 3,279,541 | 10/1966 | Knox et al. | 252/8.55 B |
| 3,342,264 | 9/1967 | Willard | 252/8.55 B |
| 3,395,757 | 8/1968 | Crossland | 252/8.55 B |
| 4,005,020 | 1/1977 | McCormick | 252/8.55 B |

*Primary Examiner*—Richard V. Fisher
*Assistant Examiner*—Marc L. Caroff
*Attorney, Agent, or Firm*—Larson, Taylor and Hinds

[57] ABSTRACT

Solid paraffin-containing material deposited on oil well surfaces are removed by contacting the deposited paraffin with an aqueous solution A composed of alkali metal metasilicate, tri(alkali metal) phosphate, tetrapotassium pyrophosphate, alkali metal hexametaphosphate, alkylphenol/ethylene oxide adduct, ethylene glycol monobutylether and methyl cellulose ether stabilizer and then adding to solution A, a solution B comprising concentrated sulfuric acid and a foam stabilizer.

6 Claims, No Drawings

HOT DETERGENT PROCESS

FIELD OF THE INVENTION

This invention relates to dispersing and/or removing solid paraffin-containing material from surfaces. More particularly, the invention relates to a hot detergent process for removing solid paraffin-containing material from surfaces such as oil and gas well tubing, flow lines, storage vessels, and similar equipment.

BACKGROUND OF THE INVENTION

Petroliferous fluids produced from oil and gas wells will frequently contain normally solid paraffinic hydrocarbons which tend to accumulate in the well bore and in the equipment utilized for producing the petroliferous fluid. In addition, the normally solid paraffins frequently tend to accumulate in transportation lines, storage vessels, and other equipment wherein the petroliferous fluids are processed. This presents a serious problem in that the deposition of paraffins interferes with the production, transportation, storage, processing, etc. of the petroliferous fluids containing such paraffinic materials. Paraffin deposition may proceed to the point where production is completely interrupted. In the past the problem of removing paraffin deposits from pumping wells and flow lines has been attacked in a number of ways. The oldest method, and perhaps the most effective heretofore, was to clean the well mechanically, e.g. by scraping. This method resulted in lost production time and high labor costs and required special tools, all of which was often too expensive to be economically feasible.

It has also been common practice to try to restore the flow of a well by cleaning the well with chemical solvents. In order to do this, hot oil or solvent has been introduced in liquid phase into the well in an effort to dissolve the undesired materials. In actuality, however, the solvents used in the prior art, have been effective only to dissolve the paraffins and other hydrocarbons that are readily soluble in organic media. Moreover, the use of such solvents has been a time-consuming and costly operation and has resulted in considerable loss of production time. Worst of all, perhaps, is that the prior art method of cleaning wells, by the use of solvents, have been largely ineffective and in many instances have served only to worsen the fouling of the well. This is because when the paraffin and other relatively soluble constituents of the sludge are removed by solvent, the proportion of insoluble soil-like constituents of the sludge rises with the result that the sludge becomes even denser and less permeable than gas and oil.

Yet another attempt to remove paraffin deposits from pumping wells and flow lines resides in utilizing an acid-bas reaction to generate heat in situ in order to dissolve the deposited paraffin. All of these cleaning operations reported in the prior art however, have been less than satisfactory for one reason or another. For instance, it has been very difficult to control the heat of reaction necessary so as to provide the desired uniform high temperature needed for efficient paraffin removal operation without redeposition of the paraffin and/or accelerated damage to the equipment.

OBJECTS

Accordingly, it is the object of the present invention to provide a process for cleaning wells, pipe lines, and the like, which does not require disassembly of the conveyor thereby precluding the costly tie up of equipment and skilled labor during cleaning operations.

It is also an object of the present invention to provide a process which avoids the costly use of solvents in the cleaning operation.

It is a further object of the invention to provide a highly efficient process which is relatively simple and easy to practice with uniformly desirable results.

Yet another object of the invention is to provide a process for cleaning wells, pipe lines, and the like characterized in that redeposition of the paraffin is substantially inhibited.

An additional object of the invention is to provide an efficient cleaning operation characterized by its ease of control and modulation.

SUMMARY OF THE INVENTION

These and other objects of the invention are obtained by a hot detergent process which comprises dispersing the solid paraffin-containing material by contacting it with an aqueous solution (A) comprising,

- alkali metal metasilicate — about 11 to 42% by weight.
- tri (alkali metal) phosphate — about 1 to 12% by weight.
- tetrasodium pyrophosphate — about 1 to 12% by weight.
- alkali metal Hydroxide — about 2 to 22% by weight.
- tetrapotassium pyrophosphate — about 1 to 12% by weight.
- alkali metal hexametaphosphate — about 1 to 15% by weight.
- alkylphenol-ethylene oxide condensation product — about 7 to 34% by weight.
- ethylene glycol monobutyl ether — about 14 to 65% by weight.
- methyl cellulose ether stabilizer — about 1 to 6% by weight.

and then adding to solution (A), a solution (B) comprising concentrated sulfuric acid and a foam stabilizer, said solution (B) being added in amount sufficient to initiate an exothermic reaction and disperse said paraffin-containing material.

Thus in the removal of normally solid, paraffin-containing material which has been deposited onto surfaces of a conduit for the transmission of a paraffinic petroliferous fluid such as the surfaces of either pumping wells, flowing wells, gas-lift wells, flow lines, transmission lines, or other pipe lines, storage tanks and the like, solution (A) is merely introduced so as to contact the deposited or obstructing paraffin-containing material, followed by the introduction of solution (B).

Another aspect of the present invention comprises adding solution (A) in a minor amount to petroleum oil and using the admixture to contact the paraffin wax deposit, followed by addition of solution (B). This aspect of the invention enables the cleaning of pumping or producing wells, for instance, by merely injecting directly into the flowing crude oil up-stream from the area restricted by the paraffin deposition the solutions (A) and (B).

BRIEF DESCRIPTION OF THE INVENTION

In greater detail the preferred forms of the invention are set forth as follows:

SOLUTION A

1. Alkali Metal Metasilicate

The alkali metasilicates act as emulsifier and peptising agents in the cleaning compositions of the present invention. The preferred alkali metal metasilicate is sodium metasilicate · $5H_2O$. The silicates of the invention function to remove large quantities of grease and paraffinic materials and also peptize agglomerates thereby removing them as solid dirt. In other words, the silicates help wet out individual particles and cause the particles to repel each other and remain in suspension until removed as by flushing. In addition, solutions of the water-soluble silicates have high specific heats and good heat transfer properties and contribute to the rapid transfer of heat to the well structure.

The amounts of alkali metal metasilicate in the solution (A) of the invention falls in a range of about 11 to 42%. If amounts in excess of 42% are employed, the cleaning and dispersion occur but the resulting product is a gel rather than a fluid suspension.

2. Trisodium Phosphate

3. Tetrasodium Pyrophosphate

4. Alkali Metal Hydroxide

5. Tetrapotassium Pyrophosphate

The above components 2 through 5 of solution (A) of the present invention are the heat generating source when combined with solution (B). The particular ingredients and their defined proportions in solution (A) have been found to cooperate so as to modulate their own exothermic neutralization by the sulfuric acid in solution (B) and yield the desired target temperature (i.e. as high a temperature as possible short of violent boiling). Ordinarily, the target temperature falls in a range of about 200° to 230° F. It is this uniform high temperature, which can be sustained over long periods of time by the process of the invention which is largely responsible for the unexpectedly efficient cleaning action achieved.

6. Alkali Metal Hexametaphosphate

The alkali metal hexametaphosphates are water softeners and are used in this capacity in the present invention. Since oil wells contain both hard water and/or salt water, the presence of a softener is necessary in order for the detergent action of the solutions of the present invention to be effective. Of the alkali metal hexametaphosphates, the sodium hexametaphosphate is preferred.

7. Alkylphenol/Ethylene Oxide Condensation Product

The alkylphenol/ethylene oxide condensation products are non-ionic surfactants described, for instance, in U.S. Pat. No. 2,927,078 to Nathan, hereby incorporated by reference. Of the alkylphenol/ethylene oxide adduct that may be employed as the non-ionic surfactant in the present invention, the preferred is nonylphenol/ethylene oxide adduct produced commercially as T-DET N9.5.

8. Ethylene Glycol Monobutylether

This compound is a wetting agent which as been found to penetrate but not to emulsify paraffin. Its presence is required since component 7 above, (i.e. the alkylphenol/ethylene oxide adduct) is lacking in penetrating power, removing only surface grease, dirt, sludge, and the like and then extremely slowly. The ethylene glycol monobutylether component thus acts as a "penetrating agent" for the alkylphenol ethylene oxide adduct.

9. Methyl Cellulose Ether Stabilizer

This component of the present invention stabilizes the dissolution of the components contained in solution (A). The mixing of solution (A) with the salt water that is found in wells or simple cooling can precipitate one or more of the components of solution (A). It has been found that in the absence of the cellulosic methyl ether stabilizer, these components would precipitate to the bottom of the solution greatly diminishing the heat generating and dispersing properties of the process of the invention. Thus, the cellulosic methyl ether component of the solution renders the performance of solution (A) stable to conditions which precipitate its active ingredients.

The balance of solution (A) is water whose proportion can vary widely, the only essential criteria being that it be present in amounts sufficient to solubilize the active ingredients of the solution. In most instances the amount of water present in solution (A) will fall in the range of about 80 to 96% by weight.

Various other ingredients may also be used in the solution (A) in order to promote the cleaning action of the process of the present invention. These other ingredients can comprise, for instance, other surfactants, stabilizers, descalers, rust inhibitors, and the like. In a particularly preferred composition, there is included in solution (A) in addition to the ingredients cited above, about 5 to 35% of a wetting agent such as Tergitol (sodium tetradecyl sulphate) and about 5 to 35% by weight of a stabilizer such as tall oil fatty acid.

SOLUTION B

The concentrated sulfuric acid component of solution (B) should be of a sufficiently high concentration in order to be able to generate the necessary exothermic reaction when combined with solution (A). In general, the concentration of the sulfuric acid should be at least 90% but it is highly preferred that the concentration of sulfuric acid fall within the range of 95 to 97%. Particularly preferred is 96% sulfuric acid. Concentrations higher than about 97% tend to have higher melting points and, therefore, tend to freeze in cold weather or upon cooling such as might occur in some wells. On the other hand, acid concentrations lower than 95% require an increase in the volumes of solution (B) that must be added in the process of the invention thereby resulting in an unnecessary dilution of the detergent and heat-generating capacity of the mixture.

Any of the well known foam stabilizers of the art can be utilized in solution (B) of the present invention. One example of such is the foam stabilizer produced commercially as Stayfoam, a commercial foam stabilizer product of Pennwalt Corporation. Another is Richamide M-3, a foam stabilizer product of Richardson Company comprised of liquid diethanolamide (100% conc.). The role of the foam stabilizer in the process of the invention is to stabilize the emulsified paraffin dispersion/emulsion.

The foam stabilizers are employed in stabilizing amounts, generally from about 5 to 15% by weight of solution (B).

Solution (B) like solution (A) may also contain other ingredients, if desired. Such optional ingredients include for instance, other surfactants, for example, the surfactant Foamore, descalers such as dibutylthiourea, corrosion inhibitors and the like.

Preparation of Solution A

Solution (A) may be simply prepared by first dissolving in water at room temperature (23° C) the alkali metasilicate, trialkali metalphosphate and tetrasodium pyrophosphate. The alkali metal hydroxide (preferably solid sodium hydroxide) and the alkali metal hexametaphosphate are separately dissolved in hot water (80-88° C) and the two solutions combined. There is then blended into the combined solution the remaining components of solution (A) and any optional components. Finally, water is added to bring the concentration of components in the final aqueous solution to about 4 to 20%.

Preparation of Solution B

Solution (B) is simply prepared by merely adding the foam stabilizers to the concentrated sulfuric acid and any of the other desired optional components.

OPERATION

As aforementioned, the hot detergent process of the present invention requires only that the solution (A) be added first to the area containing the paraffin deposit and followed by the addition of minor amounts of solution (B). The exact amounts of solution (A) to solution (B) are not critical but generally the proportion of solution (A) to solution (B) will be greater than 1:1, preferably about 3-5:1. The particular method of applying or introducing solutions (A) and (B) may vary depending upon the character of the paraffinic material deposited, its location, and whether what is being treated is a pumping well, producing well, gas-lift well, flow line, transmission line, storage tank, etc.

Certainly application of solutions (A) and (B) upstream in any system, as for example, into a well results in an attack on any such paraffinic deposits further downstream. For example, paraffin wax in traps, well tubing, pipe lines, and tanks are freed and usually flowed out of such vessels in subsequent operation of the system or by flushing with water, oil and the like. Thus, the present invention contemplates the direct introduction of solutions (A) and (B) while the well is producing.

Where deposits have been allowed to accumulate over considerable periods of time, they may be of such proportions that application of normal quantities of solutions (A) and (B) would produce sloughing of sufficient of the paraffinic deposits to plug conduits further downstream. In these instances, it is preferred to proceed more cautiously, introducing successive proportions of solutions (A) and (B) so as to dislodge proportions of the deposit which are sufficiently small so as to pass freely through the limited freeways of the existing conduits.

The following examples are given to further illustrate the present invention.

EXAMPLE 1

A solution (A) was prepared having the following composition:

1. Sodium Metasilicate $.5H_2O$ — 15 lb.
2. Trisodium Phosphate — 2½ lb.
3. Tetrasodium Pyrophosphate — 2½ lb.
4. Sodium Hexamate (sodium hexametaphosphate) — 2½ lb.
5. Sodium Hydroxide (solid) — 5 lb.
6. Tetrapotassium Pyrophosphate — 2½ lb.
7. T-DET N9.5 — 3 qts.
8. Glycol ether EB (Ethylene Glycol Monobutyl-Ether) — 3 gal.
9. Tergitol — 2 qts.
10. Acintol FA-1 (Tall oil fatty acid) — 2 qts.
11. Pengel (Cellulosic Methyl Ether) — 1 lb.

A solution B having the following composition was also prepared:

12. Dibutylthiourea — ⅛ lb.
13. Sulphuric acid (96%) — ¾ lb.
14. Foamore (or equivalent surfactant) — ⅛ lb.
15. Stafoam (or equivalent foam stabilizer) — ⅛ lb.

A solid black paraffin plug (60 grams) is placed in a wide mouth plastic bottle and about 1 liter of solution (A) is added. No reaction is observed. There is then added to the bottle ¼ of a liter of solution (B) which initiates a visibly exothermic reaction accompanied by foaming. After 1-2 minutes the plug is dispersed completely such that pouring the resultant suspension onto the pavement reveals no remaining pieces of the plug.

EXAMPLE 2

About 50 ml. of solution (A) of Example 1 is added to about 200 ml. of refined oil in a small plastic bottle containing a 5 gram, hard, black paraffin plug. The aqueous solution (A) sinks to the bottom as a clear phase causing no visible reaction. A lesser amount (20 ml) of solution (B) is then added to initiate the reaction and after approximately 1 minute, the plug is largely dispersed. After 2 or 3 minutes, the aqueous and petroleum phases have separated clearly.

EXAMPLE 3

A pumping well having a paraffin deposit problem is downhole treated by the batchwise addition in succession of 1 liter of solution (A) of Example 1 and ¼ liter of solution (B) of Example 1.

EXAMPLE 4

A flow line having a paraffin deposition problem is cleaned up by introducing into the flow line 500 cc of solution (A) of Example 1 followed by the addition of 100 cc of solution (B) of Example 1. The pipe was then washed out with water to remove the paraffinic solution and complete the cleaning operation.

It is claimed:

1. A hot detergent process for removing solid paraffin-containing material from surfaces which comprises contacting said paraffin-containing material with an aqueous solution (A) comprising, alkali metal metasilicate — about 11-42% by weight
tri(alkali metal) phosphate — about 1-12% by weight
tetrasodium pyrophosphate — about 1-12% by weight
alkali metal hydroxide — about 2-22% by weight
tetrapotassium pyrophosphate — about 1-12% by weight alkali metal hexametaphosphate — about 1–14% by weight
alkylphenol-ethylene oxide condensation product — about 7–34% by weight
ethylene glycol monobutyl ether — about 14–65% by weight
methyl cellulose ether stabilizer — about 1–67% by weight and then adding to solution (A) a solution (B) comprising concentrated sulfuric acid and a foam stabilizer, said solution (B) being added in amounts sufficient to initiate an exothermic reaction and to disperse said paraffin-containing material.

2. The process of claim 1 wherein the alkali metal metasilicate is sodium metasilicate $.5H_2O$.

3. The process of claim 1 wherein the alkali metal hydroxide is solid sodium hydroxide.

4. The process of claim 1 wherein the concentrated sulfuric acid is a sulfuric acid of 95–97% strength.

5. The process of claim 1 wherein the solution (B) includes dibutylthiourea as a descaling additive.

6. A method for treating a conduit for the transmission of a paraffinic petroliferous fluid in order to remove normally solid paraffin-containing materials deposited in said conduit which comprises contacting said deposited paraffin-containing material with an aqueous solution (A) comprising, alkali metal metasilicate — about 25–35% by weight
tri(alkali metal) phosphate — about 5–10% by weight
tetrasodium pyrophosphate — about 5–10% by weight
alkali metal hydroxide — about 8–14% by weight
tetrapotassium pyrophosphate — about 5–10% by weight
alkali metal hexametaphosphate — about 7–12% by weight
alkylphenol-ethylene oxide condensation Product — about 15–25% by weight
ethylene glycol monobutyl ether — about 25–45% by weight
methyl cellulose ether stabilizer — about 2–4% by weight and then adding to solution (A) a solution (B) comprising concentrated sulfuric acid and a foam stabilizer, said solution B being added in amounts sufficient to initiate an exothermic reaction and to disperse said deposited paraffin-containing material.

* * * * *